US008205469B2

(12) United States Patent
Tsuboi

(10) Patent No.: US 8,205,469 B2
(45) Date of Patent: Jun. 26, 2012

(54) TWO-STAGE SCREW COMPRESSOR AND REFRIGERATING DEVICE

(75) Inventor: Noboru Tsuboi, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 666 days.

(21) Appl. No.: 12/402,674

(22) Filed: Mar. 12, 2009

(65) Prior Publication Data

US 2009/0277215 A1 Nov. 12, 2009

(30) Foreign Application Priority Data

May 12, 2008 (JP) ..... 2008-124680

(51) Int. Cl.
*F25B 1/00* (2006.01)

(52) U.S. Cl. ..... 62/498; 62/510

(58) Field of Classification Search ..... 62/510, 62/498, 228.3; 418/5, 55.1, 55.4, 83; 417/321, 417/81, 83, 244, 246
See application file for complete search history.

(56) References Cited

U.S. PATENT DOCUMENTS

| | | | | |
|---|---|---|---|---|
| 3,922,114 | A * | 11/1975 | Hamilton et al. | 417/366 |
| 4,123,203 | A * | 10/1978 | Kathmann et al. | 417/252 |
| 4,878,820 | A * | 11/1989 | Doi et al. | 418/203 |
| 5,242,280 | A * | 9/1993 | Fujio | 418/11 |
| 5,261,802 | A * | 11/1993 | Yanagisawa | 418/201.2 |
| 6,631,617 | B1 * | 10/2003 | Dreiman et al. | 62/84 |
| 2004/0184922 | A1 * | 9/2004 | Cho et al. | 417/212 |

FOREIGN PATENT DOCUMENTS

| | | | |
|---|---|---|---|
| CN | 101070851 | A | 11/2007 |
| JP | 2001-65483 | | 3/2001 |
| JP | 2007-17104 | | 1/2007 |
| JP | 2007-40294 | * | 2/2007 |
| KR | 10-2007-0005461 | | 1/2007 |

OTHER PUBLICATIONS

Abstract of JP 2007-40294 to Tsuboi Noboru.*
Translation of JP 2007-40294 to Tsuboi Noboru.*
Office Action issued Apr. 28, 2011, in China Patent Application No. 200910141209.9 (with English translation).
Notice of Preliminary Rejection issued Apr. 4, 2011, in Korea Patent Application No. Oct. 2009-40530 (with English translation).
Office Action issued Nov. 26, 2010, in China Patent Application No. 200910141209.9 (with English-language Translation).

* cited by examiner

*Primary Examiner* — Mohammad Ali
(74) *Attorney, Agent, or Firm* — Oblon, Spivak, McClelland, Maier & Neustadt, L.L.P.

(57) ABSTRACT

There is provided a two-stage screw compressor including a first-stage compressor that compresses a fluid, a second-stage compressor that further compresses the fluid compressed by the first-stage compressor, a motor that drives the first-stage compressor and the second-stage compressor, and a box body that serves as a flow passage connecting an outlet of the first-stage compressor and an inlet of the second-stage compressor, and also forms a connection space storing a transmission mechanism for transmitting a rotation force from the motor to the first-stage compressor and to the second-stage compressor, wherein the connection space is sealed by the casing of the motor, and the connection space and an internal space of the casing of the motor communicate with each other.

7 Claims, 4 Drawing Sheets

TWO-STAGE SCREW COMPRESSOR AND REFRIGERATING DEVICE

BACKGROUND OF THE INVENTION

1. Field of the Invention

The present invention relates to a two-stage screw compressor and a refrigerating device.

2. Description of the Related Art

Japanese Laid-Open Patent Publication (Kokai) No. 2007-40294 discloses a two-stage screw compressor which includes a box body forming a flow passage connecting an outlet of a first-stage compressor and an inlet of a second-stage compressor, and the box body stores gears which drive rotor shafts of the first-stage and second-stage compressors. In this screw compressor, a drive shaft which drives the gears driving the rotor shafts of the first-stage and second-stage compressors passes through the box body, and a mechanical seal is provided at a pass-through portion of the drive shaft to seal a compressed fluid.

However, it is not easy to completely seal a rotating shaft, and, when a toxic refrigerant such as ammonia is to be compressed, the refrigerant cannot completely be sealed only with this mechanical seal, and there is a problem that the refrigerant leaks.

SUMMARY OF THE INVENTION

In view of the foregoing problems, it is an object of the present invention to provide a two-stage screw compressor which can completely prevent leakage of a fluid to be compressed, and a refrigerating device without leakage of a refrigerant.

In order to solve the above problems, the present invention provides a two-stage screw compressor including a first-stage compressor that compresses a fluid, a second-stage compressor that further compresses the fluid compressed by the first-stage compressor, a motor that drives the first-stage compressor and the second-stage compressor, and is stored in a casing, and a box body that serves as a flow passage connecting an outlet of the first-stage compressor and an inlet of the second-stage compressor, and also forms a connection space storing a transmission mechanism for transmitting a rotation force from the motor to the first-stage compressor and to the second-stage compressor, wherein the connection space is sealed by the casing of the motor, and the connection space and an internal space of the casing of the motor communicate with each other.

This configuration can seal a rotor shaft of the first-stage compressor, a rotor shaft of the second-stage compressor, and a shaft of the motor in a casing of the first-stage compressor, a casing of the second-stage compressor, the box body, and the casing of the motor, and it is thus not necessary to seal the rotating shafts from the outside. Therefore, the fluid to be compressed will not leak to the outside. Moreover, it is possible to eliminate a difference in pressure between the internal space of the motor and the connection space, and the fluid will thus not blow through a bearing of the motor, so grease will not flow out. Further, it is also possible to cause the fluid to be compressed to cool an interior of the motor.

Moreover, in the two-stage screw compressor according to the present invention, the casing of the motor may include a motor flow passage for introducing the fluid into the internal space of the casing.

This configuration can more surely cool the motor by introducing the fluid at a low temperature into the motor.

Moreover, the two-stage screw compressor according to the present invention may further include a jacket provided outside the casing of the motor.

This configuration can cool the motor using a refrigerant other than the fluid to be compressed. In addition, the fluid for cooling the motor will not directly contact with a stator and a rotor, will not thus excessively cool the motor, and will not induce vibration of the rotor caused by injection of the fluid.

Moreover, in the two-stage screw compressor according to the present invention, the jacket may include a flow passage which can introduce the fluid from the outside, and an internal space of the jacket may communicate with the connection space. Further, the jacket may include a flow passage which can introduce a fluid from the outside, and a flow passage which discharges the fluid introduced from the outside to the outside.

A refrigerating device according to the present invention includes the above-described two-stage screw compressor, a condenser, an expansion valve, an evaporator, and a circulation flow passage in which the two-stage screw compressor, the condenser, the expansion valve, and the evaporator are disposed.

With this configuration, in the refrigerating device, rotating shafts will not protrude to the outside, and it is thus not necessary to seal the rotating shafts from the outside. Therefore, a refrigerant will not leak to the outside.

Moreover, in the refrigerating device according to the present invention, the casing of the motor may include a motor flow passage for introducing the fluid into the internal space of the casing in the two-stage screw compressor, and the refrigerating device may further includes a cooling flow passage that introduces a part of a fluid being downstream side from the condenser to the motor flow passage.

This configuration does not leak the refrigerant to the outside, cools the motor, and can thus maintain a proper operation state.

According to the present invention, providing the connection space simultaneously serving as the flow passage connecting the outlet of the first-stage compressor and the inlet of the second-stage compressor with each other, and serving as the space storing the transmission mechanism for connecting the shafts of the first-stage compressor and the second-stage compressor with the shaft of the motor with each other, can form the sealed structure in the two-stage screw compressor. In the sealed structure, all the shafts of the first-stage compressor, the second-stage compressor, and the motor, are not exposed. As a result, the present invention provides the two-stage screw compressor without the leakage of the fluid to be compressed due to difficulty of sealing shafts completely.

DETAILED DESCRIPTION OF THE PREFERRED EMBODIMENTS

A description will now be given to embodiments of the present invention with reference to drawings.

Figure 1:
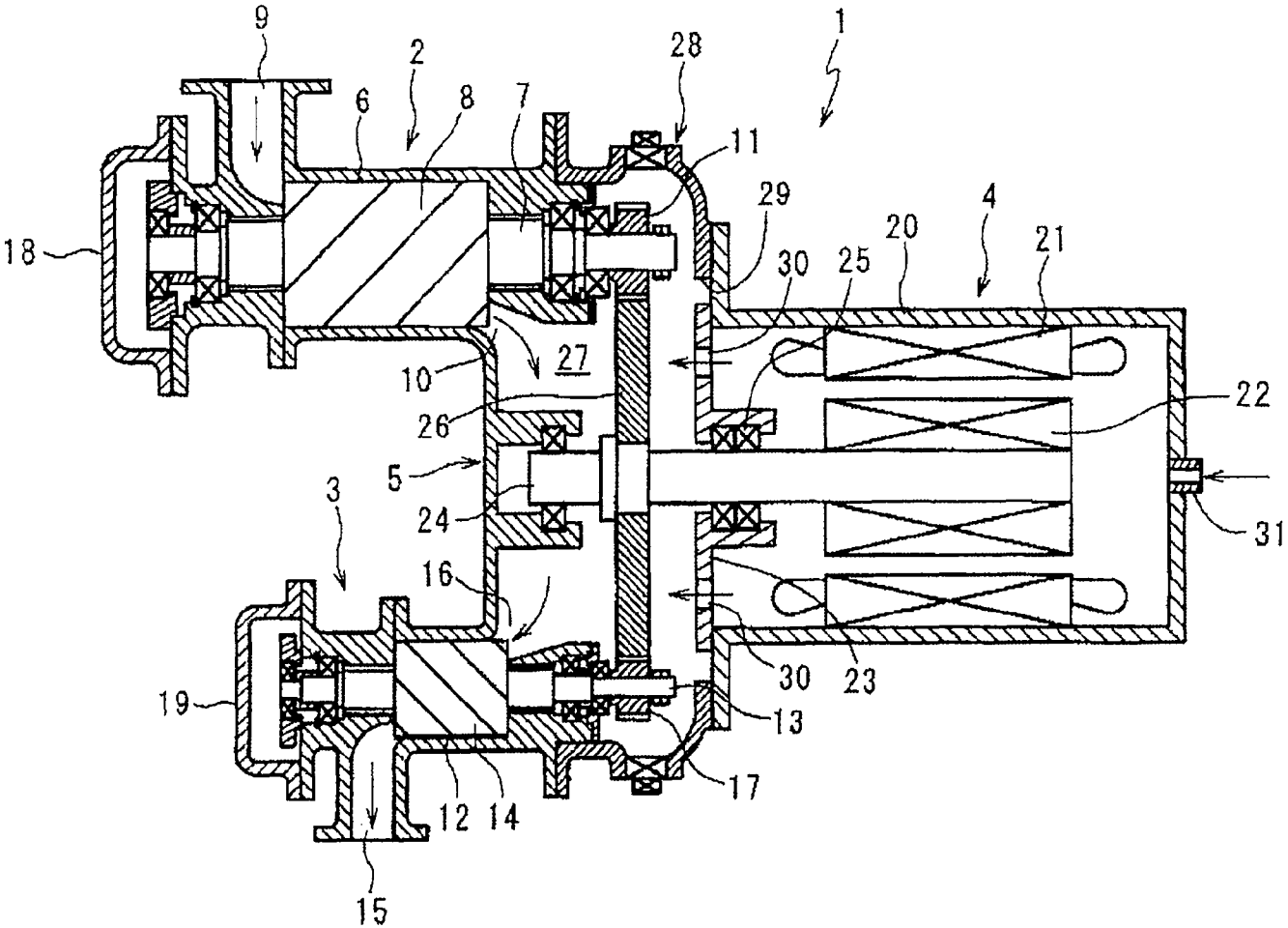
FIG. 1 is a cross-sectional view of a two-stage screw compressor according to a first embodiment of the present invention.

FIG. 1 is a cross-sectional view of a two-stage screw compressor 1 according to a first embodiment of the present invention. The two-stage screw compressor 1 includes a first-stage compressor 2 which compresses a fluid, a second-stage compressor 3 which further compresses the fluid compressed by the first-stage compressor 2, and a motor 4 which drives the first-stage compressor 2 and the second-stage compressor 3.

The first-stage compressor 2 stores a screw rotor 8 in a rotor chamber 6 formed in a common casing 5 shared by the first-stage compressor 2 and the second-stage compressor 3, and the screw rotor 8 includes a rotor shaft 7 and can rotate. An inlet flow passage 9 which can be connected via a flange to a pipe line for sucking a fluid into the rotor chamber 6 is formed on the common casing 5. On the other hand, an outlet flow passage 10 which discharges the fluid from the rotor chamber 6 is widely opened. Moreover, a pinion gear 11 used to drive the rotor shaft 7 to rotate is provided on an end on an outlet side of the rotor shaft 7.

The second-stage compressor 3 stores a screw rotor 14 including a rotor shaft 13 in a rotor chamber 12 formed in the common casing 5, and the direction of compressing the fluid by the screw rotor 14 is opposite to that of the screw rotor 8 of the first-stage compressor 2. An outlet flow passage 15 of the second-stage compressor 3 is formed on the common casing 5, and the outlet flow passage 15 can be connected via a flange to discharge the compressed fluid from the rotor chamber 12. And an inlet flow passage 16 of the second-stage compressor 3 for sucking the fluid into the rotor chamber 12 is opened on the same side as the outlet flow passage 10 of the first-stage compressor 2. Moreover, a pinion gear 17 used to drive the rotor shaft 13 to rotate is provided on an end on an inlet side of the rotor shaft 13 like the end of the outlet side of the rotor shaft 7 of the first-stage compressor 2.

Caps 18 and 19 seal the common casing 5 at an end of the inlet side of the first-stage compressor 2 and at an end of the outlet side of the second-stage compressor 3 respectively. Moreover, an end on the outlet side of the first-stage compressor 2, and an end on the inlet side of the second-stage compressor 3 are integrated with each other, therefore, the common casing 5 is largely opened.

The motor 4 stores a stator 21 and a rotor 22 in a casing 20, and is sealed by an end surface plate 23. Moreover, in the motor 4, a shaft 24 of the rotor 22 protrudes through the end surface plate 23, and the shaft 24 is supported to rotate by a bearing 25 held by the end surface plate 23. Further, a pull gear 26 is mounted on the shaft 24 of the motor 4, and the pull gear 26 meshes with the pinion gear 11 of the first-stage compressor 2 and the pinion gear 17 of the second-stage compressor 3 to drive the rotor shafts 7 and 13 to rotate.

The two-stage screw compressor 1 further includes a box body 28 which is connected to an open end of the common casing 5 to form a connection space 27 which servers as a flow passage which connects the outlet flow passage 10 of the first-stage compressor 2 and the inlet flow passage 16 of the second-stage compressor 3 with each other. The connection space 27 stores the pinion gear 11 of the first-stage compressor 2, the pinion gear 17 of the second-stage compressor 3, and the pull gear 26 of the motor 3, namely, a transmission mechanism for transmitting a rotation force from the motor 4 to the first-stage compressor 2 and the second-stage compressor 3.

An opening 29 through which the pull gear 26 can be inserted is provided on the box body 28, and this opening 29 is sealed by the casing 20 of the motor 4. Moreover, connection holes 30 which communicate an internal space of the motor 4 with the connection space 27 are provided on the end surface plate 23 of the motor 4. Moreover, a motor flow passage 31 in a nozzle shape is provided on the casing 20 of the motor 4 to introduce the same fluid that is compressed by the two-stage screw compressor 1 into an internal space of the casing 20.

In the two-stage screw compressor 1, any of the rotating shafts are not exposed to the outside. Therefore, dynamic seals are not necessary for sealing the fluid to be compressed within the compressor, and only static seals such as packings and gaskets can surely prevent the fluid from leaking.

Moreover, the provision of the connection holes 30 prevents an operation state of the two-stage screw compressor 1 from generating a difference in pressure between the connection space 27 and the internal space of the motor 4, therefore, the fluid is not blown through the inside of the bearing 25, so grease and lubricant in the bearing 25 is not washed out, and the bearing 25 is consequently not worn soon. Further, heat generated inside the motor 4 is taken by the fluid flowing into the internal space of the motor 4, and is then released to the outside from the second-stage compressor 3, so the motor 4 is prevented from being overheated. Moreover, the motor 4 is more efficiently prevented from being overheated by introducing a fluid at a low temperature from the motor flow passage 31 if necessary.

Figure 2:
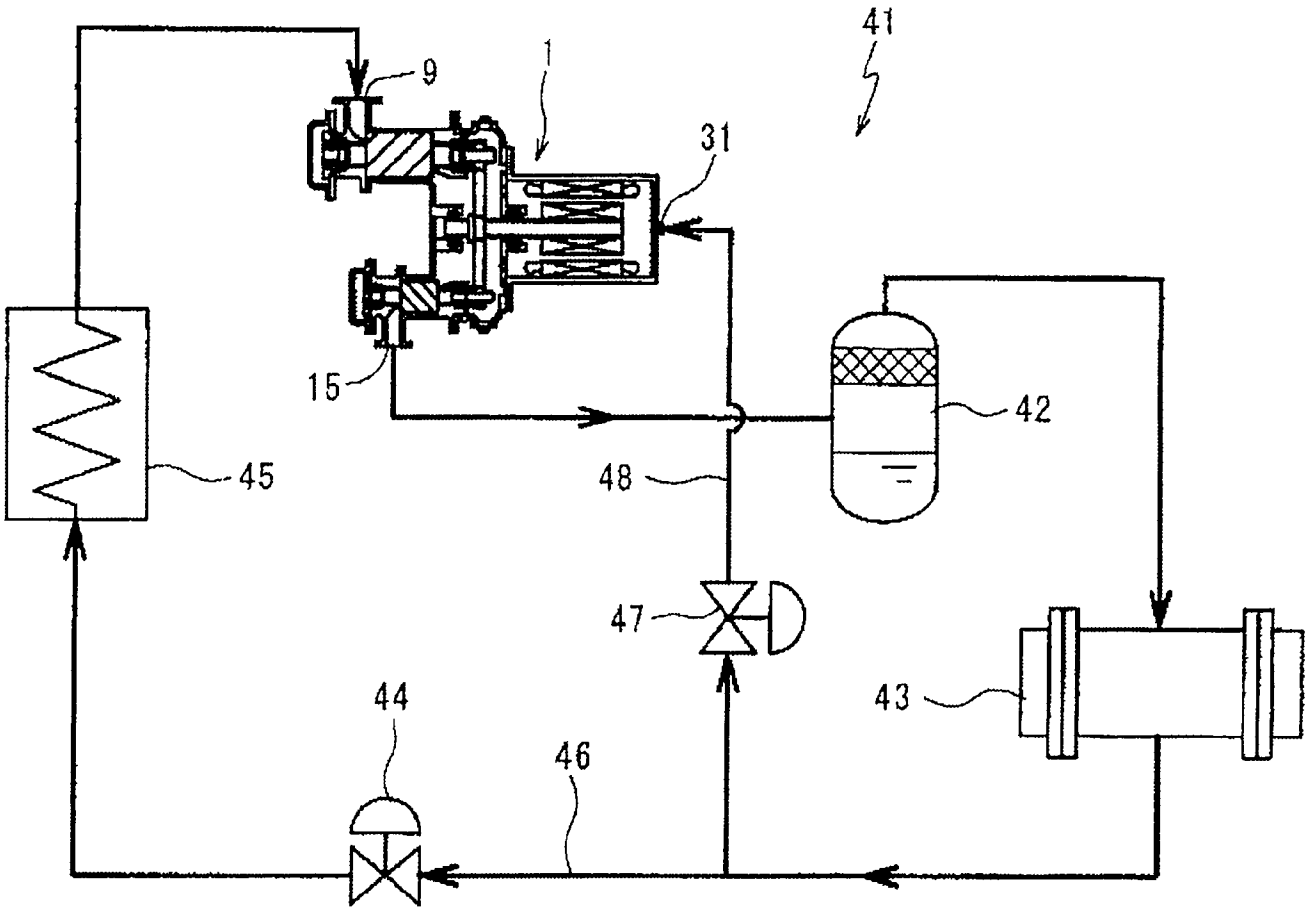
FIG. 2 is a schematic diagram of a refrigerating device including the two-stage screw compressor shown in FIG. 1.

FIG. 2 shows a refrigerating device 41 employing the two-stage screw compressor 1 according to the first embodiment. The refrigerating device 41 includes a circulation flow passage 46 in which the two-stage screw compressor 1, an oil separator 42, a condenser 43, an expansion valve 44, and an evaporator 45 are disposed, the circulation flow passage 46 circulating a refrigerant, and further includes a cooling flow passage 48 which introduces a part of the refrigerant from the downstream side of the circulation flow passage 46 with respect to the condenser 43, to the motor flow passage 31 of the two-stage screw compressor 1 via an expansion valve 47.

According to the present embodiment, the refrigerant will not leak, and the motor of the two-stage screw compressor 1 is cooled to perform an efficient operation. Moreover, the refrigerant introduced from the motor flow passage 31 cools the motor 4, then passes through the connection holes 30, and is sucked into the inlet flow passage 16 of the second-stage compressor 3. In other words, in case of a two-stage screw compressor in which two stages of compressors, namely the first-stage compressor 2 and the second-stage compressor 3, are serially arranged as in the present embodiment, it is important to prevent the fluid (refrigerant) sucked from the inlet flow passage 9 of the first-stage compressor 2 from being heated for preventing the weight flow rate of the sucked fluid (refrigerant) from decreasing. According to the present embodiment, since the refrigerant heated to a certain level after cooling the motor 4, is not sucked from the inlet flow passage 9 of the first-stage compressor 2, but from the inlet flow passage 16 of the second-stage compressor 3, the fluid (refrigerant) sucked from the inlet flow passage 9 of the first-stage compressor 2 is not heated, and the decrease of the weight flow rate is thus prevented. Thus, a sufficient quantity of the refrigerant can pass through the evaporator 45, and the refrigerating device 41 thus can exert a sufficient refrigerating performance.

Figure 3:
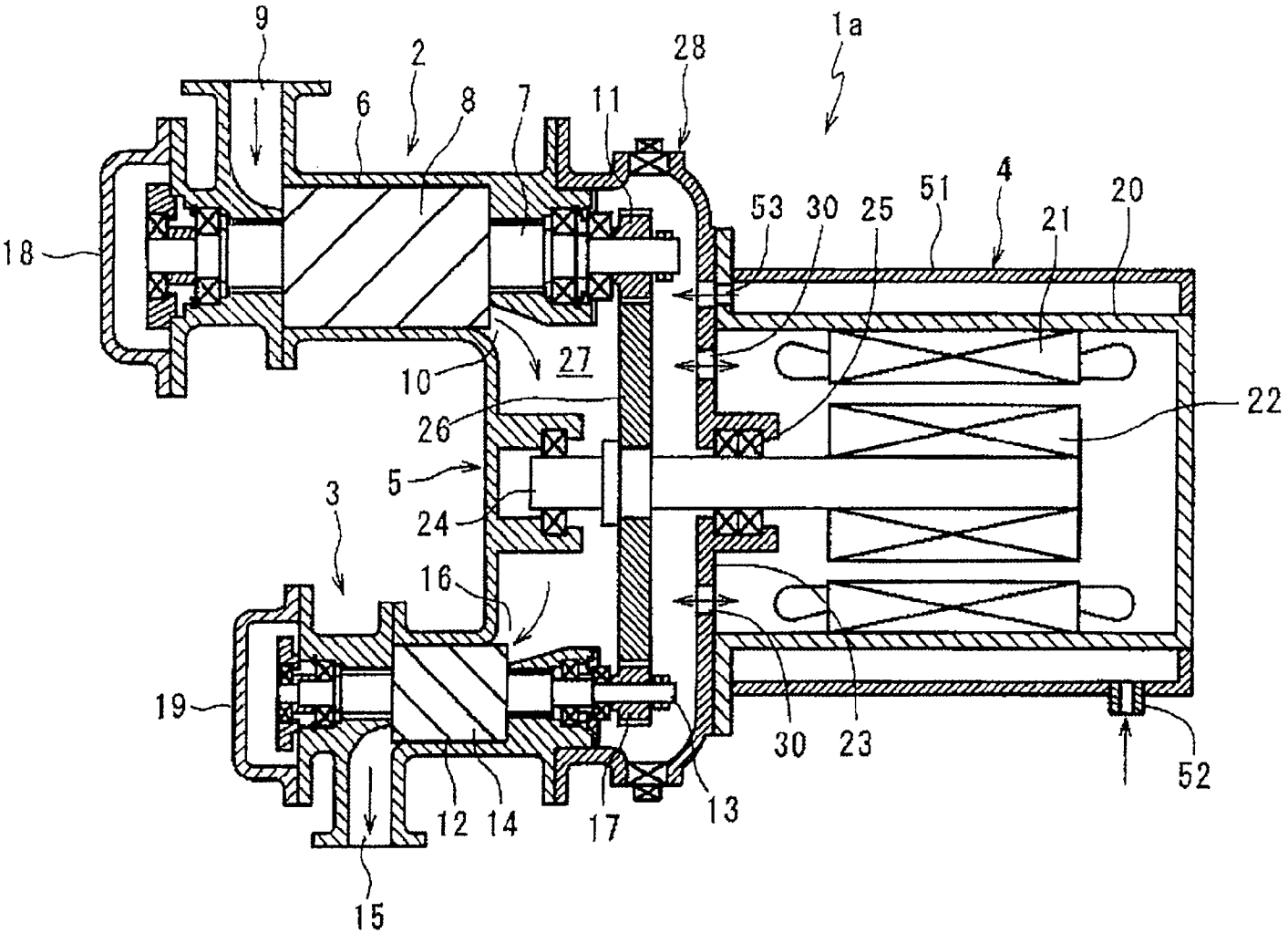
FIG. 3 is a cross-sectional view of a two-stage screw compressor according to a second embodiment of the present invention.

FIG. 3 shows a two-stage screw compressor 1*a* according to a second embodiment of the present invention. In the following description, same components as the first embodiment are denoted by same numerals, and repeated explanation therefor will be omitted. According to the present embodiment, the motor 4 includes a jacket 51, the jacket 51 being provided with a motor flow passage 52 for introducing the fluid to be compressed, and the casing 20 is provided with a communication hole 53 for communicating the jacket 51 and the connection space 27 with each other.

According to the present embodiment, the stator 21 and the rotor 22 of the motor 4 are indirectly cooled, and the motor 4 is thus not overcooled. Moreover, the fluid to be compressed such as a refrigerant does not leak out also from the two-stage screw compressor 1*a* according to the present embodiment. Moreover, since the fluid is not directly injected on the rotor 22 or the like of the motor 4, vibration of the motor 4 caused by injection of the fluid will not be induced.

Figure 4:
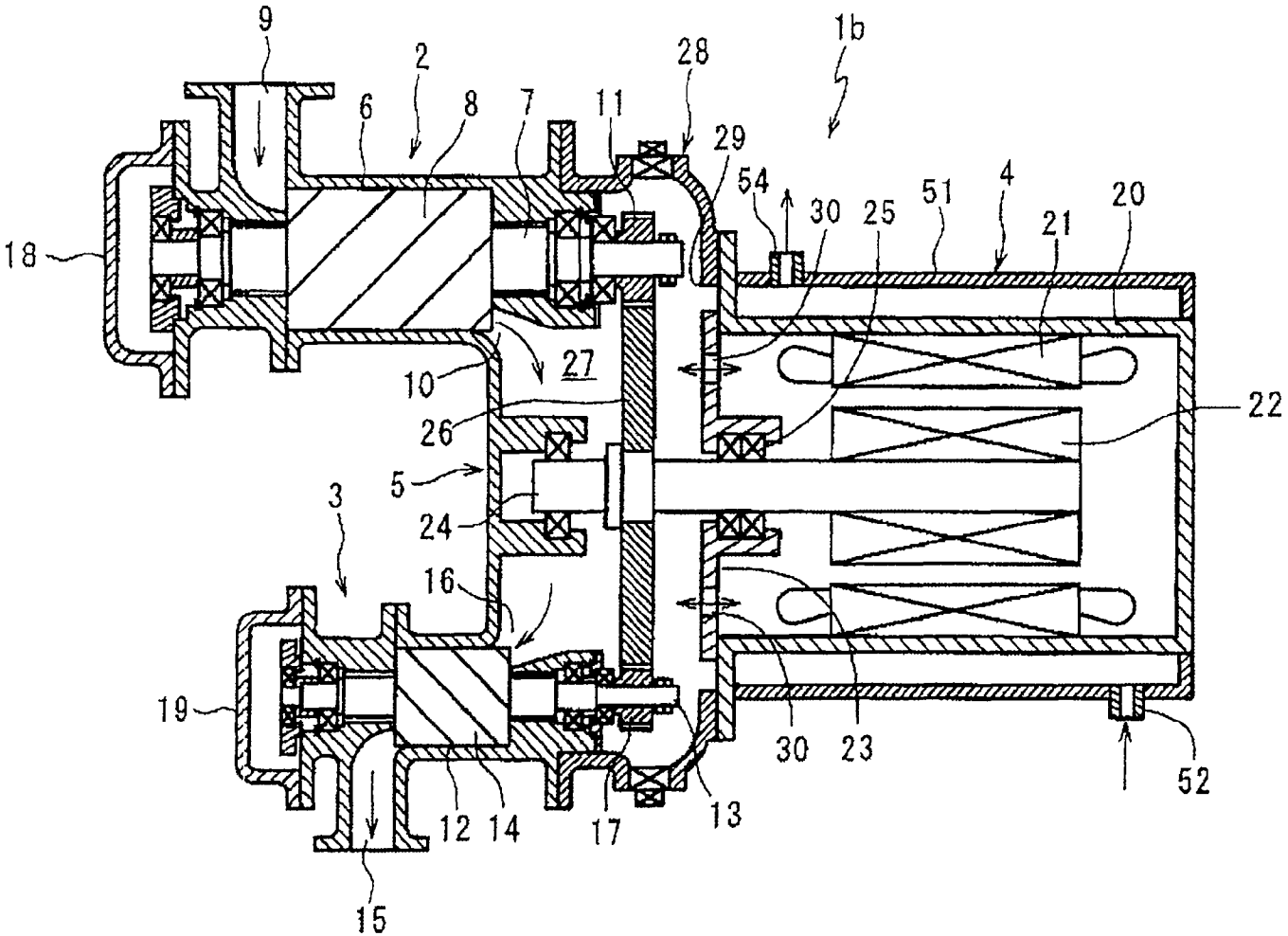
FIG. 4 is a cross-sectional view of a two-stage screw compressor according to a third embodiment of the present invention.

Further, FIG. 4 shows a two-stage screw compressor 1*b* according to a third embodiment of the present invention. According to the present embodiment, the communication hole 53 is not provided, and the jacket 51 is isolated from the connection space 27. Then, the jacket 51 is includes a flow-out flow passage 54 which serves as a flow outlet of a fluid introduced from the motor flow passage 52.

According to the present embodiment, a fluid different from the fluid to be compressed by the two-stage screw compressor 1*b* can be introduced into the jacket 51, and is caused to cool the motor 4. Of course, the fluid to be compressed by the two-stage screw compressor 1*b* may be introduced into the jacket 51, and the fluid flowing out the flow-out flow passage 54 may be fed to the inlet flow passage 9 of the two-stage screw compressor 1*b*.

Moreover, according to the present invention, the box body 28 for forming the connection space 27 may be formed integrally with the casing 5 of the first-stage compressor 2 and/or the second-stage compressor 3.

What is claimed is:

1. A two-stage screw compressor, comprising:

a first-stage compressor that compresses a fluid;

a second-stage compressor that further compresses the fluid compressed by said first-stage compressor;

a motor that drives said first-stage compressor and said second-stage compressor, and is stored in a casing; and a box body that serves as a flow passage connecting an outlet of said first-stage compressor and an inlet of said second-stage compressor, and also forms a connection space storing a transmission mechanism for transmitting a rotation force from said motor to said first-stage compressor and to said second-stage compressor, wherein said connection space is sealed from the exterior of the compressor by said casing of said motor, and said connection space and an internal space of said casing of said motor communicate with each other.

2. The two-stage screw compressor according to claim 1, wherein said casing of said motor comprises a motor flow passage for introducing the fluid into said internal space of said casing.

3. The two-stage screw compressor according to claim 1, further comprising a jacket provided outside said casing of said motor.

4. The two-stage screw compressor according to claim 3, wherein said jacket comprises a flow passage which can introduce the fluid from the outside, and an internal space of said jacket communicates with said connection space.

5. The two-stage screw compressor according to claim 3, wherein said jacket comprises a flow passage which can introduce a fluid from the outside, and a flow passage which discharges the fluid introduced from the outside to the outside.

6. A refrigerating device comprising:

said two-stage screw compressor according to claim 1;

a condenser;

an expansion valve;

an evaporator; and a circulation flow passage in which said two-stage screw compressor, said condenser, said expansion valve, and said evaporator are disposed.

7. The refrigerating device according to claim 6, wherein said casing of said motor comprises a motor flow passage for introducing the fluid into said internal space of said casing in said two-stage screw compressor, the refrigerating device further comprises a cooling flow passage that introduces a part of a fluid being downstream side from said condenser to said motor flow passage.

* * * * *